US009861206B2

(12) United States Patent
Corodemus

(10) Patent No.: US 9,861,206 B2
(45) Date of Patent: Jan. 9, 2018

(54) MATTRESS TOPPERS COMBINING FOAM AND POCKET COIL LAYERS

(71) Applicant: Comfort Revolution, LLC, West Long Branch, NJ (US)

(72) Inventor: Dimitrios Corodemus, West Long Branch, NJ (US)

(73) Assignee: Comfort Revolution, LLC, West Long Branch, NJ (US)

( * ) Notice: Subject to any disclaimer, the term of this patent is extended or adjusted under 35 U.S.C. 154(b) by 0 days.

(21) Appl. No.: 14/223,823

(22) Filed: Mar. 24, 2014

(65) Prior Publication Data

US 2014/0283307 A1 Sep. 25, 2014

Related U.S. Application Data

(60) Provisional application No. 61/804,491, filed on Mar. 22, 2013.

(51) Int. Cl.

| | |
|---|---|
| ***A47C 27/05*** | (2006.01) |
| ***A47C 27/06*** | (2006.01) |
| ***A47C 31/10*** | (2006.01) |
| ***A47C 27/00*** | (2006.01) |

(52) U.S. Cl.

CPC ..... *A47C 27/056* (2013.01); *A47C 27/002* (2013.01); *A47C 27/064* (2013.01); *A47C 31/105* (2013.01)

(58) Field of Classification Search

CPC ... A47C 27/056; A47C 31/105; A47C 27/053; A47C 27/064; A47C 27/002; A47C 27/063

USPC ..... 5/654, 716, 717, 720, 721, 690, 691

See application file for complete search history.

(56) References Cited

U.S. PATENT DOCUMENTS

| | | | | |
|---|---|---|---|---|
| 2,461,062 | A * | 2/1949 | Kane | A47C 27/063 5/720 |
| 6,397,418 | B1 * | 6/2002 | Stjerna | A47C 27/062 5/655.8 |
| 6,877,177 | B1 * | 4/2005 | Marcangelo | A47C 27/003 5/192 |
| 2004/0010854 | A1 * | 1/2004 | Oakhill | A47C 19/20 5/716 |
| 2004/0133988 | A1 * | 7/2004 | Barber | 5/716 |
| 2004/0172767 | A1 * | 9/2004 | Mossbeck et al. | 5/720 |
| 2004/0237204 | A1 * | 12/2004 | Antinori | 5/716 |
| 2005/0097676 | A1 * | 5/2005 | Rensink | 5/721 |
| 2005/0223496 | A1 * | 10/2005 | Oakhill et al. | 5/716 |

(Continued)

*Primary Examiner* — Eric J Kurilla

(74) *Attorney, Agent, or Firm* — Doherty IP Law Group LLC

(57) ABSTRACT

A mattress topper includes a pocket coil pad having a top surface and a bottom surface. The pocket coil pad includes a plurality of pockets, each pocket having a compressible coil that moves independently of the other compressible coils of the pad. The mattress topper includes a first foam pad overlying and connected with the top surface of the pocket coil pad, and a second foam pad overlying and connected with the bottom surface of the pocket coil pad. The compressible coils are joined together by a fabric covering that holds the compressible coils together as a unitary structure. The compressible coils have a height of about ¼ inch or greater. The pocket coil pad and the first and second foam pads cover an area that is the same size such as single, twin, queen, king, and California king sizes.

14 Claims, 4 Drawing Sheets

(56) References Cited

U.S. PATENT DOCUMENTS

| | | | | |
|---|---|---|---|---|
| 2005/0273939 | A1* | 12/2005 | Mossbeck | 5/720 |
| 2005/0278862 | A1* | 12/2005 | Kuchel et al. | 5/716 |
| 2006/0096032 | A1* | 5/2006 | Rensink | 5/721 |
| 2007/0017034 | A1* | 1/2007 | Creekmuir | 5/717 |
| 2007/0022540 | A1* | 2/2007 | Hochschild | A47C 27/001 5/727 |
| 2007/0151034 | A1* | 7/2007 | Gladney et al. | 5/727 |
| 2007/0204407 | A1* | 9/2007 | Lee | 5/720 |
| 2008/0092302 | A1* | 4/2008 | Rensink | 5/690 |
| 2008/0184493 | A1* | 8/2008 | Mossbeck et al. | 5/720 |
| 2008/0263774 | A1* | 10/2008 | Lee | A47C 31/001 5/691 |
| 2009/0106908 | A1* | 4/2009 | DeFranks et al. | 5/716 |
| 2009/0144910 | A1* | 6/2009 | DeFranks et al. | 5/716 |
| 2009/0222985 | A1* | 9/2009 | Richmond | A47C 27/053 5/247 |
| 2010/0115703 | A1* | 5/2010 | Kluft | 5/717 |
| 2010/0155704 | A1* | 6/2010 | Oh et al. | 257/28 |
| 2010/0318239 | A1* | 12/2010 | Oexman et al. | 700/301 |
| 2011/0173757 | A1* | 7/2011 | Rensink | A47C 27/04 5/698 |
| 2011/0191962 | A1* | 8/2011 | Frame | 5/717 |
| 2011/0197367 | A1* | 8/2011 | Mossbeck | 5/655.8 |
| 2012/0316254 | A1* | 12/2012 | Gelinas | C08G 18/4804 521/137 |
| 2013/0000043 | A1* | 1/2013 | Bullard et al. | 5/654.1 |
| 2013/0000044 | A1* | 1/2013 | Bullard | 5/654.1 |
| 2013/0276239 | A1* | 10/2013 | Roma | A47C 23/04 5/717 |
| 2015/0026893 | A1* | 1/2015 | Garrett et al. | 5/691 |

* cited by examiner

MATTRESS TOPPERS COMBINING FOAM AND POCKET COIL LAYERS

BACKGROUND OF THE INVENTION

Field of the Invention

The present invention relates to mattress toppers and more particularly relates to mattress toppers that combine one or more foam layers, such as memory foam, and one or more pocket coil layers.

Description of the Related Art

A conventional mattress topper is a cushioned pad that sits on top of a mattress. A mattress topper may have straps that are placed around each corner of the mattress to minimize slipping or sliding of the pad.

Many individuals use a mattress topper to compensate for a bed that is too firm. For many years, the most popular types of mattress toppers included egg crate foam or thin feather beds, which were sized to beds of various sizes. Both types were often available for less than $50, and provided an inexpensive way to make a mattress more comfortable Today, many mattress toppers are made using memory or visco elastic foam, which many feel is a more comfortable and hypoallergenic alternative to feather beds. Because some individuals still like the feel of a feather bed topper, some mattress toppers now combine both the features of feather beds and memory foam.

Some mattress toppers have soft wool covers to provide warmth on cold nights. Some mattress toppers are used as both a mattress topper and a mattress cover, whereby they cover the mattress like a fitted sheet, and may have waterproofing.

In spite of the above advances, there remains a need for improved mattress toppers.

SUMMARY OF THE INVENTION

In one embodiment, a mattress topper preferably includes a pocket coil pad having a top surface and a bottom surface, the pocket coil pad including a plurality of pockets, each pocket having a compressible coil that moves independently of the other compressible coils of the pad. A foam pad desirably overlies and is connected with one of the top and bottom surfaces of the pocket coil pad.

In one embodiment, the mattress topper preferably includes a first foam pad overlying and connected with the top surface of the pocket coil pad, and a second foam pad overlying and connected with the bottom surface of the pocket coil pad.

In one embodiment, the foam pad overlies and is connected with the bottom surface of the pocket coil pad. In one embodiment, the foam pad overlies and is connected with the top surface of the pocket coil pad.

In one embodiment, the compressible coils are joined together by a fabric covering that holds the compressible coils together as a unitary structure. The compressible coils preferably have a height of about ¼ inch or greater than ¼ inch.

In one embodiment, the foam pad may be made of memory foam, latex foam, conventional foam, and combinations thereof.

In one embodiment, the pocket coil pad and the foam pad cover an area that is the same size. In one embodiment, the mattress topper may include a plurality of mattress toppers having different sizes such as single, twin, queen, king, and/or California king sizes.

In one embodiment, a mattress topper preferably includes a pocket coil pad having a top surface and a bottom surface, the pocket coil pad including a plurality of pockets, each pocket having a compressible coil that moves independently of the other compressible coils of the pad, a first foam pad overlying and connected with the top surface of the pocket coil pad, and a second foam pad overlying and connected with the bottom surface of the pocket coil pad.

In one embodiment, a mattress topper desirably includes a pocket coil pad having a top surface and a bottom surface, the pocket coil pad including a plurality of pockets, each pocket having a compressible coil that moves independently of the other compressible coils of the pad, wherein the compressible coils are joined together by a fabric covering that holds the compressible coils together as a unitary structure. The compressible coils preferably have a height of about ¼ inch or greater. The mattress topper preferably includes a first memory foam pad overlying and connected with the top surface of the pocket coil pad, and a second memory foam pad overlying and connected with the bottom surface of the pocket coil pad. The pocket coil pad and the first and second memory foam pads desirably cover an area that is the same size such as single, twin, queen, king, and/or California king sizes.

These and other preferred embodiments of the present invention will be described in more detail below.

DETAILED DESCRIPTION

In one embodiment, the mattress topper preferably includes a combination of fabric, pocket coil springs and foam. In one embodiment, the foam may be memory foam, conventional foam, latex, or one or more combinations thereof.

Figure 1A:
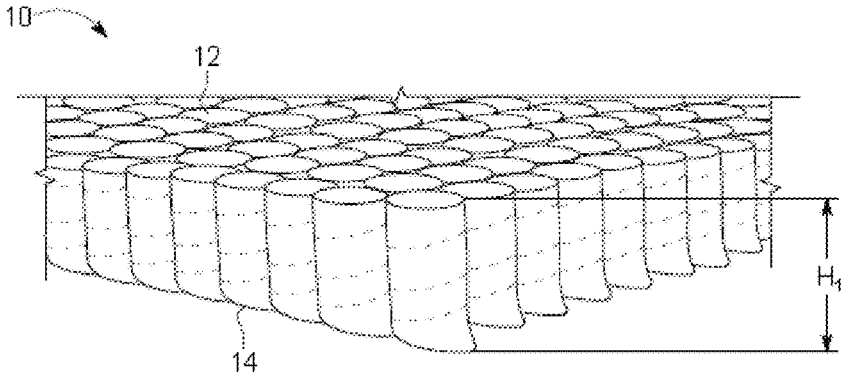
FIGS. 1A-1C shows a perspective view of a pocket coil pad for a mattress topper including a plurality of pockets with compressible coils that are joined together by a fabric covering that holds the coils together as a unitary structure, in accordance with one embodiment of the present invention.
Figure 1B:
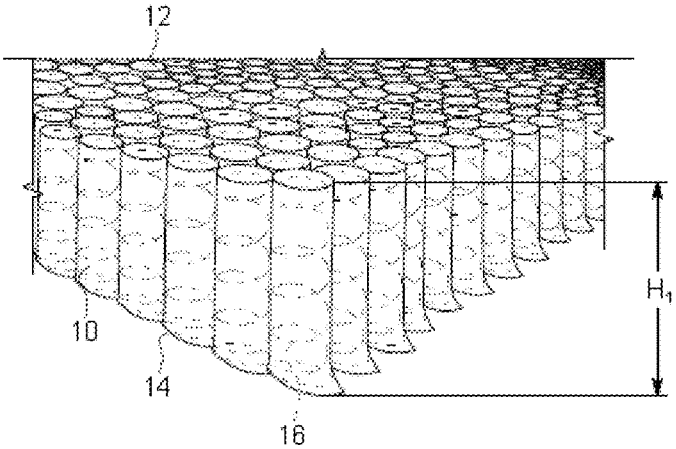
Figure 1C:
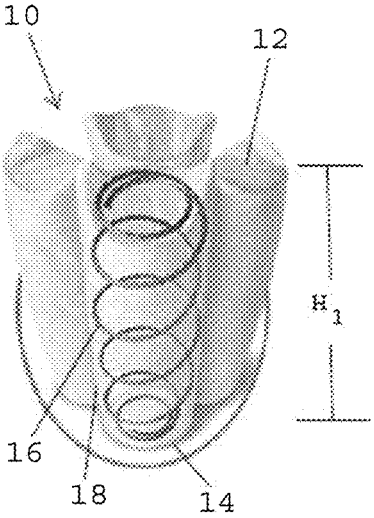

Referring to FIGS. 1A-1C, in one embodiment, a mattress topper preferably includes a pocket coil pad 10 having a top surface 12 and a bottom surface 14. The pocket coil pad 10 preferably covers an area that is about the size of a mattress. Thus, the pocket coil pad 10 may come in different sizes including Single, Twin, Queen, King, California King, etc., for covering different sized mattresses.

In one embodiment, the pocket coil pad 10 preferably has a plurality of coils 16 having a height $H_1$ of about ¼". In one embodiment, the coils are desirably joined together via a fabric covering 18 that holds the coils together as a unitary structure. In one embodiment, the coils 16 may have a height that is greater than ¼ inch.

Figure 2:
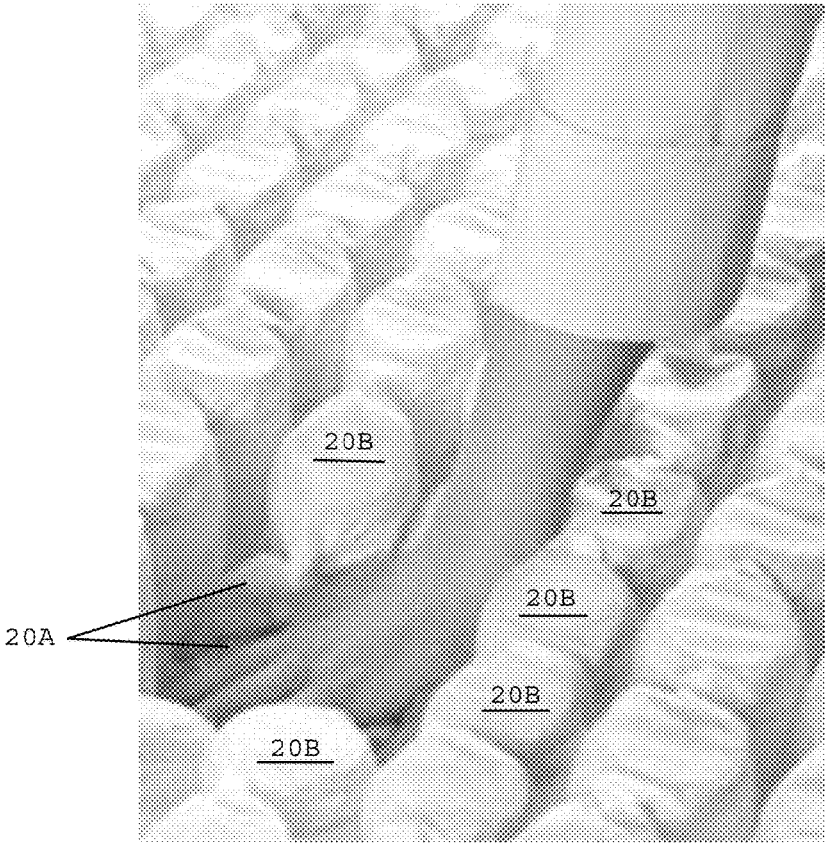
FIG. 2 shows the pocket coil pad of FIGS. 1A-1C with some of the compressible coils being compressed, in accordance with one embodiment of the present invention.

Referring to FIG. 2, the pocket coil pad 10 preferably has a plurality of pockets 20A, 20B that move independently of one another. The pockets 20A that are engaged by a force will compress, while the surrounding pockets 20B that are not engaged by the force will retain a normal, uncompressed configuration.

Figure 3A:
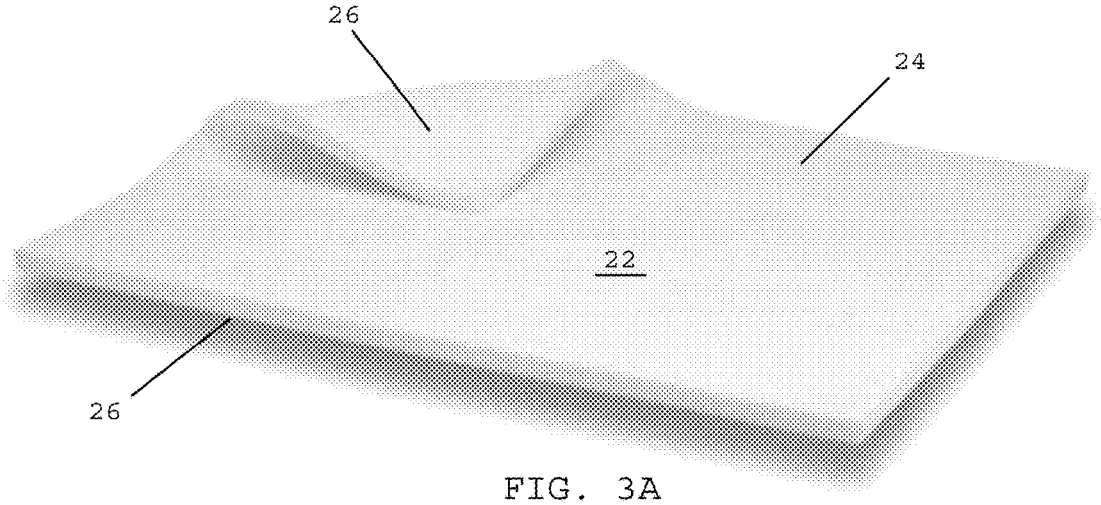
FIGS. 3A-3B show a perspective view of a foam pad for a mattress topper, in accordance with one embodiment of the present invention.
Figure 3B:
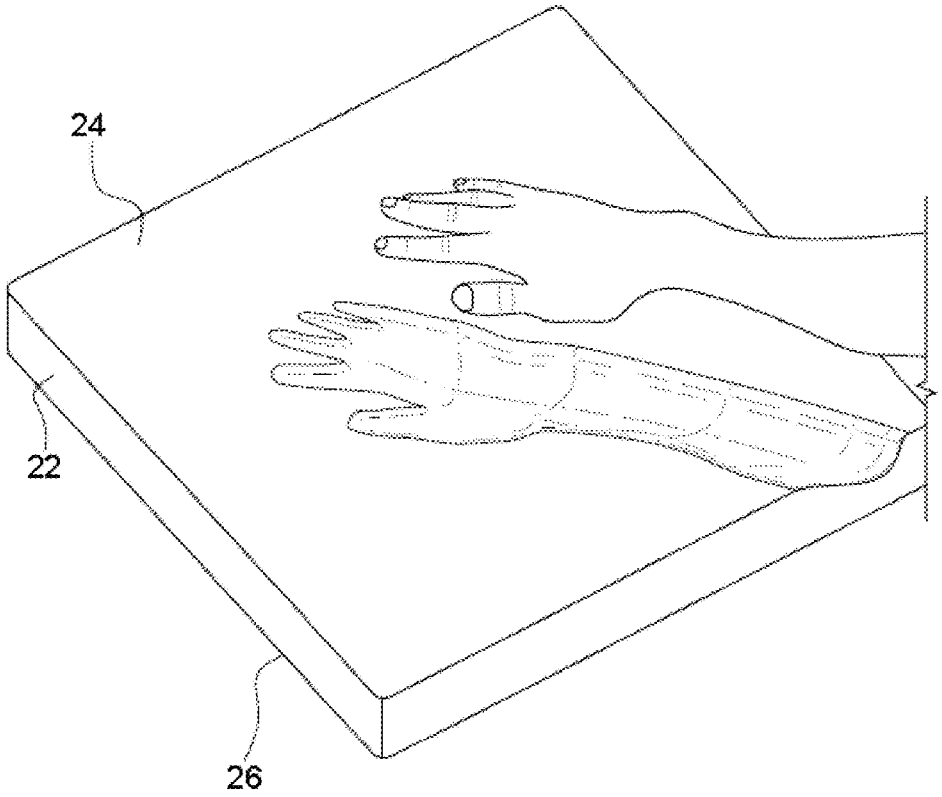

Referring to FIGS. 3A and 3B, in one embodiment, the mattress topper preferably includes a foam pad 22 having a top surface 24 and a bottom surface 26. The foam pad 22 preferably covers an area that matches the area covered by the pocket coil pad 10. In one embodiment, the foam pad 22 comprises memory foam. In one embodiment, the foam pad 22 preferably comprises a conventional foam pad. Referring to FIG. 3B, in one embodiment, when the foam pad 22 is compressed, the foam pad generally conforms to the shape and configuration of the element providing the compression force upon the foam pad (e.g., a hand and arm as shown in FIG. 2B).

FIGS. 4-7 show schematic diagrams of mattress toppers having various combinations of one or more layers of pocket coil pads 10 and one or more layers of foam pads 22. In one embodiment, a mattress topper may include a single pocket coil pad sandwiched between two foam pads. In one embodiment, a mattress topper may include a single foam pad sandwiched between two pocket coil pads. In one embodiment, a mattress topper may include a single pocket coil pad joined with a single foam pad, whereby the foam pad may be the top layer of the mattress topper or the bottom layer of the mattress topper.

Figure 4:
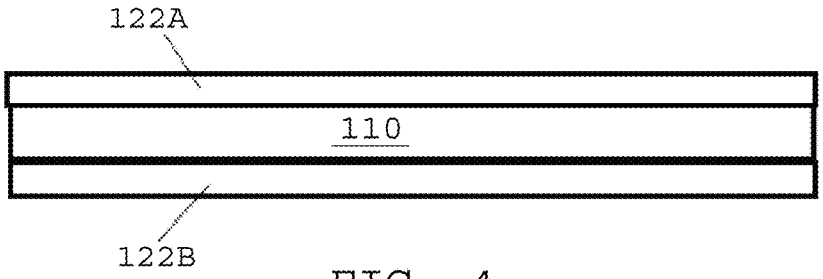
FIG. 4 shows a mattress topper including a pocket coil pad sandwiched between a first foam pad and a second foam pad, in accordance with one embodiment of the present invention.

Referring to FIG. 4, in one embodiment, a mattress topper preferably includes a pocket coil pad 110 sandwiched between a top foam layer 122A and a bottom foam layer 122B. In one embodiment, the mattress topper preferably has a thickness of about ½-1 inch. In one embodiment, the mattress topper has a thickness of about 1 inch. In another embodiment, the mattress topper preferably has a thickness of about 1-4 inches.

Figure 5:
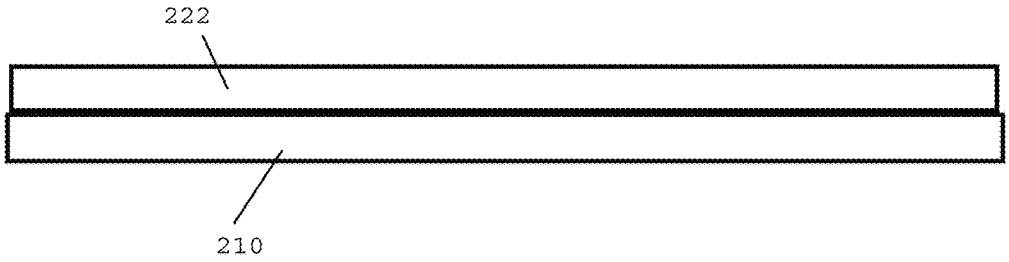
FIG. 5 shows a mattress topper including a pocket coil pad and a foam pad overlying and connected with a top surface of the pocket coil pad, in accordance with one embodiment of the present invention.

Referring to FIG. 5, in one embodiment, a mattress topper preferably includes a pocket coil pad 210 that forms a bottom layer of the mattress topper and a foam layer 222 that forms a top layer of the mattress topper.

Figure 6:
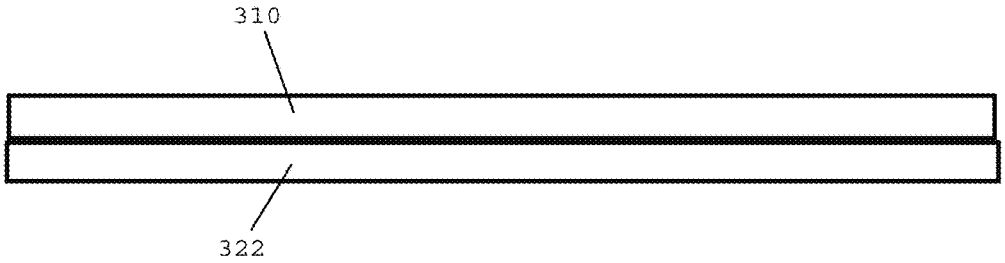
FIG. 6 shows a mattress topper including a pocket coil pad and a foam pad overlying and connected with a bottom surface of the pocket coil pad, in accordance with one embodiment of the present invention.

Referring to FIG. 6, in one embodiment, a mattress topper preferably includes a foam layer 322 that forms a bottom layer of the mattress topper and a pocket coil pad 322 that forms a top layer of the mattress topper.

Figure 7:
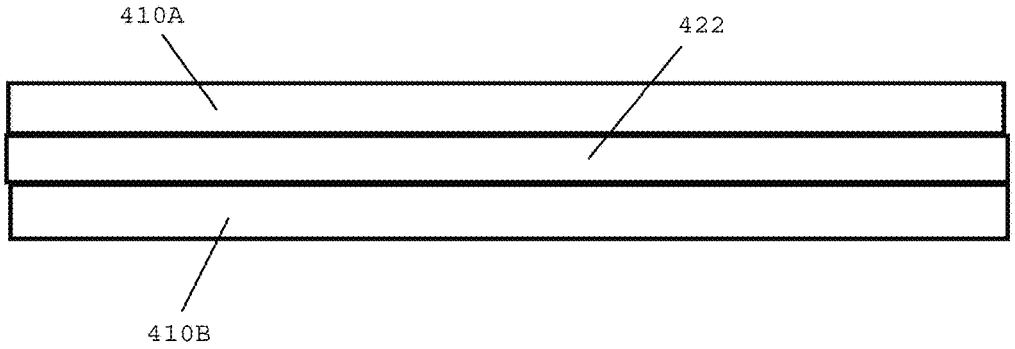
FIG. 7 shows a mattress topper including a foam pad sandwiched between a first pocket coil pad and a second pocket coil pad, in accordance with one embodiment of the present invention.

Referring to FIG. 7, in one embodiment, a mattress topper preferably includes a foam pad 422 sandwiched between a top pocket coil pad 410A and a bottom pocket coil pad 410B.

Other embodiments may include mattress toppers having two or more pocket coil pads and two or more foam pads combined in different combinations to form a mattress topper for covering a mattress.

In one embodiment, mattress topper includes a series of ¼" tall springs/pocket coils (or taller) are glued or otherwise bound together to form a pad the same size or similar to the same size as a foam pad. The pocket coil layer is 'sandwiched' between two layers of foam (whether conventional foam, memory foam and/or latex) This is a two sided application of springs/pocket coils where the coils are in the middle of one or more layers on each side.

In one embodiment, a mattress topper includes a series of ¼" tall springs/pocket coils (or taller) which are glued or otherwise bound together to form a pad the same size or similar to the same size as a foam pad, and is placed on top or below a layer or layers of foam (whether conventional foam, memory foam and/or latex) This is a two sided application of springs/pocket coils on one side and foam/latex on the other.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A mattress topper comprising: a pocket coil pad having a length and a width configured to cover an area the size of a mattress, said pocket coil pad having a top surface and a bottom surface, said pocket coil pad including a plurality of pockets, each said pocket having a compressible coil that moves independently of other compressible coils of said pad, wherein said compressible coils have a height of about ¼ inch, and wherein said compressible coils are joined together by a fabric covering that holds said compressible coils together as a unitary structure; a first foam pad overlying and connected with one of said top and bottom surfaces surface of said pocket coil pad; a second foam pad overlying and connected with said bottom surface of said pocket coil pad; wherein said fabric covering that holds said compressible coils together as a unitary structure overlies upper and lower ends of said compressible coils, and wherein said fabric covering that holds said compressible coils together as a unitary structure is disposed entirely between opposing major faces of said first and second foam pads; wherein said mattress topper overlies said mattress and covers the area the size of said mattress.

2. The mattress topper as claimed in claim 1, wherein said mattress topper has a thickness of about 1 inch.

3. The mattress topper as claimed in claim 1, wherein said foam pads are selected from the group of foam pads consisting of memory foam, latex foam and conventional foam.

4. The mattress topper as claimed in claim 1, wherein said pocket coil pad and said foam pad cover an area that is the same size.

5. The mattress topper as claimed in claim 4, wherein said mattress topper comprises a plurality of mattress toppers having different sizes including single, twin, queen, king, and California king sizes.

6. A mattress topper comprising: a pocket coil pad having a length and a width configured to cover an area the size of a mattress, said pocket coil pad having a top surface and a bottom surface, said pocket coil pad including a plurality of pockets, each said pocket having a compressible coil that moves independently of other compressible coils of said pad, wherein said compressible coils have a height of about ¼ inch, and wherein said compressible coils are joined together by a fabric covering that holds said compressible coils together as a unitary structure; a first foam pad overlying and connected with said top surface of said pocket coil pad; and a second foam pad overlying and connected with said bottom surface of said pocket coil pad, wherein said fabric covering that holds said compressible coils together as a unitary structure overlies upper and lower ends of said compressible coils, and wherein said fabric covering that holds said compressible coils together as a unitary structure is disposed entirely between opposing major faces of said first and second foam pads; wherein said mattress topper overlies said mattress.

7. The mattress topper as claimed in claim 6, wherein said mattress topper covers the area about the size of said mattress.

8. The mattress topper as claimed in claim 6, wherein said pocket coil pad and said first and second foam pads cover an area that is the same size.

9. The mattress topper as claimed in claim 8, wherein said mattress topper comprises a plurality of mattress toppers having different sizes including single, twin, queen, king, and California king sizes.

10. The mattress topper as claimed in claim 6, wherein said foam pads are selected from the group of foam pads consisting of memory foam, latex foam and conventional foam.

11. The mattress topper as claimed in claim 6, wherein said mattress topper has a thickness of between ½ inch and four inches.

12. A mattress topper for a mattress comprising: a pocket coil pad having a length and a width configured to cover an area the size of a mattress, said pocket coil pad having a top surface and a bottom surface, said pocket coil pad including a plurality of pockets, each said pocket having a compressible coil that moves independently of other compressible coils of said pad, wherein said compressible coils are joined together by a fabric covering that holds said compressible coils together as a unitary structure, and wherein said compressible coils have a height of about ¼ inch; a first memory foam pad overlying and connected with said top surface of said pocket coil pad; and a second memory foam pad overlying and connected with said bottom surface of said pocket coil pad, wherein said mattress topper overlies a mattress, wherein said fabric covering that holds said compressible coils together as a unitary structure overlies upper and lower ends of said compressible coils, and wherein said fabric covering that holds said compressible coils together as a unitary structure is disposed entirely between opposing major faces of said first and second memory foam pads; wherein said mattress topper overlies said mattress.

13. The mattress topper as claimed in claim 12, wherein said pocket coil pad and said first and second memory foam pads cover an area that is the same size, and wherein said mattress topper comprises a plurality of mattress toppers having different sizes including single, twin, queen, king, and California king sizes.

14. The mattress topper as claimed in claim 1, wherein said first foam pad overlies said top surface of said pocket coil pad, said mattress further comprising a second pocket coil pad overlying a top surface of said first foam pad so that said first foam pad is disposed between said first and second pocket coil pads.

* * * * *